United States Patent [19]

Darnfors

[11] 4,224,062

[45] Sep. 23, 1980

[54] HIGH TEMPERATURE CREEP RESISTANT STRUCTURAL STEEL

[75] Inventor: Sven Darnfors, Avesta, Sweden

[73] Assignee: Avesta Jernverks Aktiebolag, Avesta, Sweden

[21] Appl. No.: 5,974

[22] Filed: Jan. 24, 1979

Related U.S. Application Data

[63] Continuation-in-part of Ser. No. 862,818, Dec. 21, 1977, abandoned, which is a continuation of Ser. No. 607,957, Aug. 26, 1975, abandoned.

[30] Foreign Application Priority Data

Aug. 24, 1974 [SE] Sweden ..... 7410791

[51] Int. Cl.[2] ..... C22C 38/40

[52] U.S. Cl. ..... 75/128 E; 75/128 N; 75/128 A; 75/128 C; 148/36; 148/136

[58] Field of Search ..... 75/128 E, 128 N, 128 A, 75/128 C; 148/36, 136

[56] References Cited

U.S. PATENT DOCUMENTS

| | | | |
|---|---|---|---|
| 2,553,330 | 5/1951 | Post et al. | 75/122 |
| 2,635,044 | 4/1953 | Mott | 75/125 |
| 3,119,687 | 1/1964 | Kirschning | 75/128 E |
| 3,362,813 | 1/1968 | Ziolkowski | 75/128 R |
| 4,007,038 | 2/1977 | Deverell | 75/122 |
| 4,099,966 | 4/1978 | Chivinsky et al. | 75/128 E |
| 4,102,677 | 7/1978 | Deverell | 75/128 E |
| 4,108,641 | 8/1978 | Fujioka et al. | 75/128 E |

FOREIGN PATENT DOCUMENTS

| | | |
|---|---|---|
| 231488 | 6/1963 | Austria . |
| 1024719 | 2/1958 | Fed. Rep. of Germany . |
| 1053845 | 7/1953 | France . |
| 2228119 | 11/1974 | France . |
| 215852 | 10/1967 | Sweden . |
| 313324 | 8/1969 | Sweden . |
| 1142333 | 2/1969 | United Kingdom . |
| 1210064 | 10/1970 | United Kingdom . |
| 1316048 | 5/1973 | United Kingdom . |

OTHER PUBLICATIONS

Handbuch der Sonderstahlkunde, Houdremont, Springer-Verlage, pp. 822, 1466-1467, (1956).

Die Edelstahle, Rapatz, Springer-Verlag, pp. 309-311, 688, (1962).

"Avesta 253 MA-The New High Temperature Steel", Avesta publication, 10/77.

*Primary Examiner*—G. Ozaki

*Attorney, Agent, or Firm*—Brumbaugh, Graves, Donohue & Raymond

[57] ABSTRACT

Austenitic steel structural members having improved high temperature creep strength are formed by incorporating a rare earth metal and an alkaline earth metal into a fully austenitic steel.

10 Claims, 2 Drawing Figures

HIGH TEMPERATURE CREEP RESISTANT STRUCTURAL STEEL

BACKGROUND OF THE INVENTION

This is a continuation-in-part of application Ser. No. 862,818 filed Dec. 21, 1977, now abandoned, which was a continuation of application Ser. No. 607,957 filed Aug. 26, 1975, now abandoned.

The present invention relates to structural steel members and, more particularly, to steel alloy structural members having improved creep strength and resistance to repeated high temperature variations.

For constructions exposed to great temperature variations, it has proved difficult to find a material that does not loose its fit by expanding and contraction during heating and cooling. It has also been difficult to find a material that is not entirely or partially destroyed by various hot gases. A further desirable property that is difficult to realize is the ability to join together, for example by welding, different parts made of a single material, which is exposed to great temperature variations, by means of a joint that in all respects has a strength equal to that of the structural members in general.

Previously known steels with austenitic structure, but not containing rare earth metals or earth alkali metals, have been used where creep strain is high and are capable of resisting loads of up to 14 Newtons per square millimeter ($N/mm^2$) (AISI 330) or 10 $N/mm^2$ (AISI 310) with 1 percent creep during 1000 hours at a temperature of 900° C. Nevertheless, there is a need for steel with even greater creep resistance and the ability to withstand repeated temperature variations.

In U.S. Pat. No. 2,553,330 issued to Post et al. there are disclosed austenitic alloys of steel having creep resistance at high temperatures. These ferrous alloys contain nickel, carbon and at least one of the elements chromium, molybdenum and tungsten. In order to improve the workability of these alloys, Post et al. recommend the inclusion of the rare earth metals, cerium or lanthanum or both in the form of misch metal. In addition the earth alkali metal beryllium can be added to impart age-hardening tendencies. Generically the Post et al. alloy comprises in percent by weight:

| | |
|---|---|
| Carbon | 0.0–0.50 |
| Chromium, Molybdenum, and/or Tungsten | 10.0–60.0 |
| Nickel | 4.0–70.0 |
| Copper | 0.0–10.0 |
| Nitrogen | 0.0–0.3 |
| Cobalt | 0.0–40.0 |
| Manganese | 0.0–20.0 |
| Silicon | 0.0–4.0 |
| Columbium, Tantalum, and/or Vanadium | 0.0–8.0 |
| Titanium | 0.0–2.0 |
| Cerium and/or Lanthanum | 0.02–1.10 |
| Beryllium | 0.0–5.0 |
| Boron | 0.0–2.0 |
| Aluminum | 0.0–5.0 |
| Zirconium | 0.0–2.0 |
| Sulfur, Selenium, Tellurium, Phosphorus, and/or Arsenic | Sufficient to allow free machining in corrosion resistant steel |

By improving the hot workability as suggested by Post et al. there is a natural tendency to decrease the creep resistance of the steel at elevated temperatures.

An alloy with improved thermal neutron absorption and hot workability is described in U.S. Pat. No. 3,362,813 to Ziolkowski. This alloy has the general composition in percentage by weight: 0.0–0.25 Carbon; 0.0–10.0 Manganese; 0.0–2.0 Silicon; 0.0–1.0 Phosphorus, Sulfur and/or Selenium; 12.0–26.0 Chromium; 3.5–22.0 Nickel; 0.0–4.0 Molybdenum; 0.0–4.0 Copper; 0.0–4.0 Aluminum; 0.0–1.25 Titanium; 0.0–1.25 Columbium; 0.0–0.7 Nitrogen; 0.2–3.0 Gadolinium and balance iron and incidental impurities. This results in a steel that is generally austenitic, but has 5 to 25% ferrite, which ferrite produces a very brittle sigma phase in the temperature range of 600°–900° C. Besides producing steel that is brittle at these temperatures, this steel is not suited to the precipitation of finely dispersed oxide particles from the addition of rare earth metals.

SUMMARY OF THE INVENTION

The present invention is directed to structural steel members that are fully austenitic and, more particularly, to such members that contain rare earth metals and earth alkali metals that impart improved high temperature creep resistance to the member.

In an illustrative embodiment the steel alloy which forms the structural member contains 0.002–0.12 percent by weight of earth alkali metals and rare earth metals, 0.0–0.2% Carbon, 1.0–3.0% Silicon, 0.2–2.0% Manganese, 15.0–25.0% Chromium, 5.0–20.0% Nickel, 0.12–0.22% Nitrogen in an amount sufficient to assure that the alloy is fully austenitic, and remainder iron and incidental impurities. In an amount of up to 0.12 percent by weight of the earth alkali and rare earth metals the alloy constituting the structural members exhibits extreme creep strength even when exposed to repeated variations in temperature, for example, from normal ambient temperature up to temperatures of 1200° C. In this connection it is suitable to add the rare earth metals as misch metal or other master alloys containing rare earth metals.

In a preferred embodiment calcium in the amount 0.002–0.006 is used as the earth alkali metal and 0.03–0.07 cerium is used as the rare earth metal. Nitrogen in an amount of up to 0.30 percent, preferably 0.12 to 0.22 percent is used as an austenite stabilizing alloying constitute.

BRIEF DESCRIPTION OF THE DRAWINGS

The foregoing and other features of the present invention will be more readily apparent from the following detailed description and drawings of illustrative embodiments of the invention in which.

DESCRIPTION OF EXEMPLARY EMBODIMENTS

Figure 1:
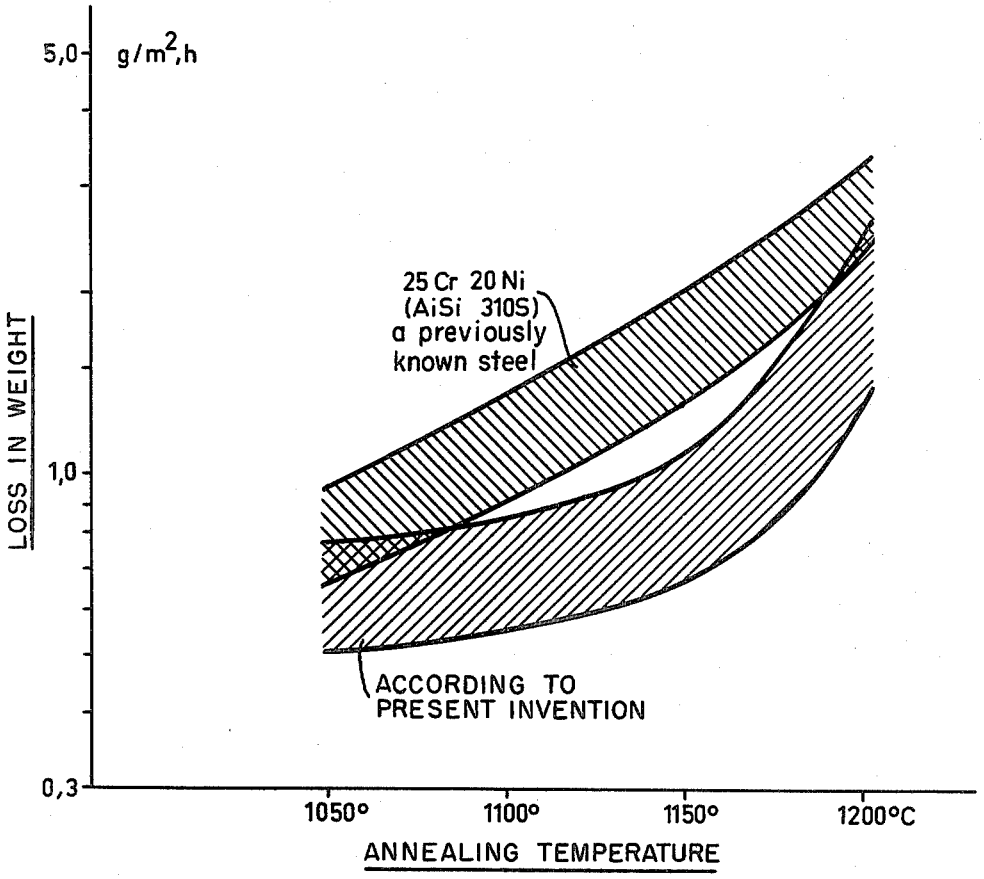
FIG. 1 is a graph comparing annealing losses for the present invention to those of a prior art alloy.

The term "rare earth metals" in this connection is to be understood to refer to lanthanum and other lanthanides. Three metals in group 2a of the periodical system, viz. calcium, strontium and barium, are regarded as "earth alkali metals" in this application in conformance with the text "General Inorganic Chemistry" by Sneed and Maynard.

The steel of the present invention can be used for exhaust cleaners for motor-cars and industrial installations of different kinds, for example, furnaces, furnace details or parts, and accessories with high requirements on shape stability. A sufficiently high shape stability makes it possible to replace particularly exposed parts, such as different parts in the interior of combustion chambers and encasing material for ceramic parts in catalytic cleaners, where the ceramics must be exchangeable. The present steel can also be used for caps, pipes and furnace parts required to fit well with other parts of the furnace structure. In addition the steel is applicable to the fitting of furnace accessories, such as charging baskets and boxes, which in continuous furnace plants permanently pass through complete heat cycles.

The standard values and optimized preferred composition limits of the steel of the present invention are as follows:

TABLE I

| Element | Broad Range | Preferred Range |
|---|---|---|
| Carbon | 0.0–0.20 | 0.08–0.12 |
| Silicon | 1.0–3.0 | 1.5–2.3 |
| Manganese | 0.2–2.0 | 0.3–0.7 |
| Chromium | 15.0–25.0 | 19.0–22.0 |
| Nickel | 5.0–20.0 | 8.0–12.0 |
| Nitrogen | 0.0–0.3 in such an amount that a fully austenitic structure is obtained | 0.0–0.3 |
| One or more of the rare earth metals and earth alkali metals | 0.002–0.12 | 0.002–0.006 Ca<br>0.03–0.07 Ce |

and other elements with high oxygen affinity (e.g. yttrium or zirconium) in a total amount of maximally 2 percent, the remainder being iron and unintentional impurities.

Austenitic steels containing rare earth metals or earth alkali metals in an amount up to 0.12 percent have only a 1 percent creep when subjected to a load of about 16 $N/mm^2$ for 1000 hours at a temperature of 900° C. This compares favorably with prior art austenitic steels without rare earth or earth alkali metals which require substantially higher alloy contents and produce the same creep at 900° C. for only a load of 14 $N/mm^2$. This difference is of importance and is accentuated even more under difficult conditions. The increase in creep strength is believed to be due to the fact that an advantageous finely dispersed phase is separated when alloying elements, such as nitrogen and rare earth metals, are added in such an amount that the solubility is exceeded. Particularly suitable is a steel with alloying additions of metals of the lanthanum group which produce a very finely distributed oxide phase when subjected to deoxidation conditions. These oxide particles are high temperature stable and improve the creep resistance of the steel at high temperatures.

The use of steels with said properties has proved highly advantageous in tests. The inner part in a thermoreactor with a double casing, for example, has proved to be entirely accurate with respect to size and without any change in weight after the thermoreactor was tested on a motor in a bench test. The reactor was subjected to 600 rapid cycles, with the temperature of its inner part varying between 1040° C. and 200° C. A comparative test with an inner part of ferritic chromium steel resulted in deformation and failing operation after 200 cycles. Another test was carried out with three automobile exhaust cleaners of the catalytic type with ceramic pellets. After test driving through a distance corresponding in length to the distance requested in the United States for such tests, i.e. 80,000 kilometers, the exhaust cleaners were still in good condition for continued use. A tube furnace, furthermore, was subjected to 20,000 batch annealings, without changing its shape. A furnace made of the 25Cr/20Ni type alloy, however, collapsed after about 500 annealings. These tests also demonstrated good weld strength for the steel.

The great technical advantages of the use of the steel according to the invention for the intended purposes are also apparent from the accompanying FIG. 1, which by way of a diagram shows annealing losses at intermittent annealing for a steel according to the invention. In FIG. 1 the present invention, as shown in the lower field, is compared with steels previously used for the same purpose, as shown in the upper field.

It has been found that a particularly useful structural member can be produced by using calcium in the range 0.002–0.006% and cerium from 0.03–0.07%. Similar steels both without the preferred range (Steel A) and within the range (Steel B) were produced. The analyses of the steels were as follows:

TABLE II

| ELEMENTS | A | B |
|---|---|---|
| C | 0.044% | 0.069% |
| Si | 1.47% | 1.78% |
| Mn | 0.29% | 0.34% |
| Cr | 21.05% | 21.08% |
| Ni | 10.97% | 10.95% |
| Ce | 0.027% | 0.032% |
| N | 0.173% | 0.172% |
| Ca | 0.001% | 0.004% |

Figure 2:
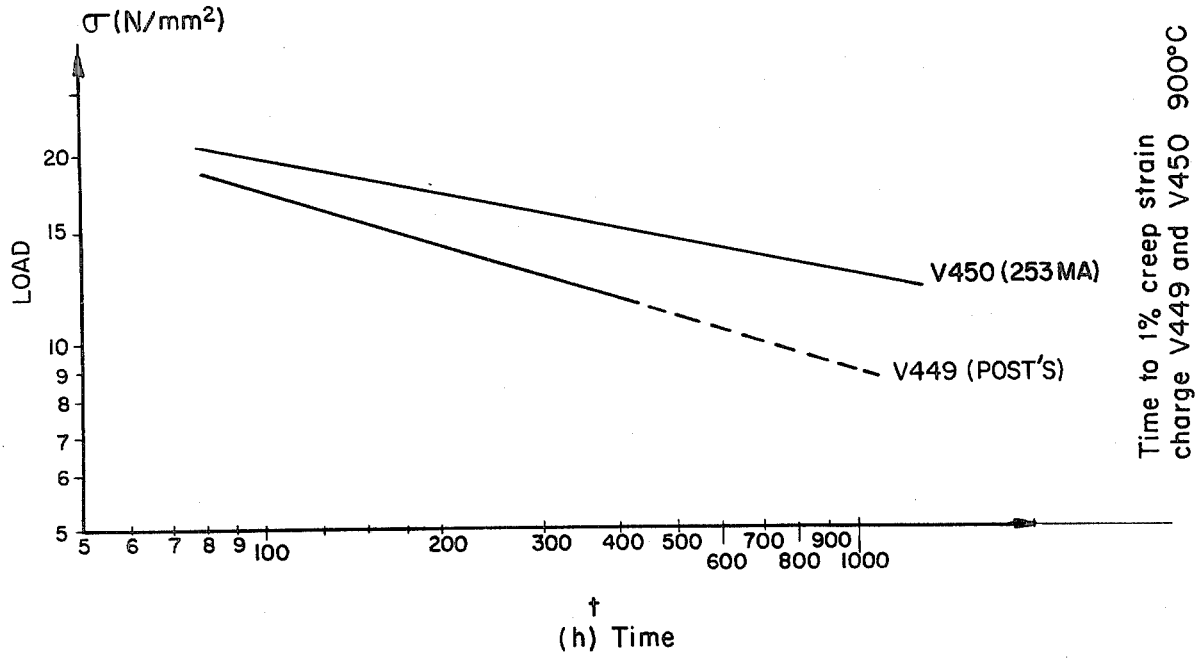
FIG. 2 is a graph comparing the time for 1% creep at various loads for the present alloy to those of a prior art alloy.

Creep tests were carried out on these steels by measuring the time for up to 1% creep strain at 900° C. and at various loads ($N/mm^2$). The results are shown in TABLE III and in FIG. 2. From FIG. 2 and TABLE IV it is apparent that steel B shows much better values for creep strain resistance than does steel A. In order to obtain a value at 1000 h for steel B the test results were extrapolated to 1000 h in the usual way. This shows improved creep values for the calcium-cerium steel.

TABLE III

| Load $N/mm^2$ | Time in hours for 1% creep strain at 900° C. A | B |
|---|---|---|
| 13 | 264 | 1045 |
| 14 | 182 | 448 |
| 15 | 195 | 498 |
| 16 | 136 | 291 |
| 17 | 106 | 205 |
| 20 | — | 92.5 |

TABLE IV

| Charge | Limits of creep strain in $N/mm^2$ at 900° C. $R_k1/300$ | $R_k1/500$ | $R_k1/1000$ |
|---|---|---|---|
| A | 12.7 | 10.9 | 9.0 |
| B | 16.0 | 14.6 | 12.9 |

In addition the creep tests run on the steels of the preferred embodiment of the present invention and those containing calcium outside the limits show that the creep resistance, besides being higher for the preferred embodiment, does not decline with time as much as for steels with less calcium. This can be seen from FIG. 2 by the different inclinations of the two lines. The better creep resistance of the calcium steel is caused by finely dispersed oxide particles precipitated in the molten state when calcium is added to the melt. The fine oxide particles act as effective obstacles to creep in the steel structure.

Although the carbon content of steel B in the example is higher than that in steel A it is believed that the strengthening mechanism of the precipitated oxide particles acts far more effectively on the creep resistance than does the higher carbon content. Essentially the difference in carbon content in the example is insignificant. The carbon acts through solution hardening and this hardening effect is lost when the steel is heated to 900°–1200° C., whereas the oxide particles are unchanged at the same temperatures.

The improved creep resistance of the present invention also differs from the age hardening tendencies of beryllium, mentioned in the Post patent, which hardening occurs in the solid state. In particular this age hardening is accomplished by heat treatment of the steel at low temperatures (350°–500° C.) for comparatively short times. If such an age hardened steel is heated much above those age hardening temperatures, it softens because the carbon precipitates formed during the age hardening, coalesce into rounded forms of carbides, like those formed in soft annealing ordinary carbon steels. At temperatures of 900°–1200° C. the present steel can be used because the oxide particles remain hard and unaffected by the heat, even for prolonged periods. Therefore, the hardening mechanism caused by calcium is quite different from the age hardening tendencies of beryllium in the Post alloys. The precipitate formed in age hardening of the latter alloys softens after prolonged heating above recommended age hardening temperatures (350°–500° C.).

While the invention has been particularly shown and described with reference to preferred embodiments thereof, it will be understood by those skilled in the art that various changes in form and details may be made therein without departing from the spirit and scope of the invention.

I claim:

1. A structural member having improved high temperature creep resistance such that it exhibits only about 1% creep when subjected to a load of 16 Newtons per square millimeter for 1000 hours at a temperature of up to about 900° C., said member being formed from a fully austenitic steel alloy consisting of the following ingredients in percentages by weight:

0.002–0.12% total content of two elements, the first element being selected from the group consisting of the alkaline earth metals, calcium, strontium and barium and the second element being selected from the group consisting of the rare earth metals, lanthanum and other lanthanides, at least some portion of each element being present;

0.0–0.20% Carbon;

1.0–3.0% Silicon;

0.2–2.0% Manganese;

15.0–25.0% Chromium;

5.0–20.0% Nickel;

0.12–0.22% Nitrogen, said Nitrogen being added in amounts sufficient to assure that said alloy is fully austenitic; and remainder iron and incidental impurities.

2. A structural member as claimed in claim 1 wherein said structural member exhibits the high temperature creep resistance at constant temperatures up to about 1200° C.

3. A structural member as claimed in claim 1 wherein said structural member exhibits the high temperature creep resistance during repeated temperature variations from normal ambient temperatures up to about 1200° C.

4. A structural member as claimed in claim 1 wherein said total content of said two members is 0.03 to 0.07% by weight, said carbon content is from 0.08 to 0.12% by weight, said silicon content is from 1.5 to 2.3% by weight, said manganese is from 0.3 to 0.7% by weight, said chromium is from 19 to 22% by weight, and said nickel is from 8 to 12% by weight.

5. A structural member as claimed in claims 1 and 4 wherein said second member is misch metal.

6. A structural member as claimed in claims 1 and 4 wherein said second member is cerium.

7. A structural member as claimed in claims 1 and 4 wherein said first member is calcium.

8. A structural member as claimed in claims 1 and 4 wherein said first member is calcium and its content is 0.002–0.006% by weight, and wherein said second member is cerium and its content is 0.03–0.07% by weight.

9. A structural member having improved high temperature creep resistance such that it exhibits only about 1% creep when subjected to a load of 16 Newtons per square millimeter for 1000 hours at a temperature of up to about 900° C., said member being formed from a fully austenitic steel alloy consisting of the following ingredients in percentages by weight:

0.002–0.12% total content of two elements, the first element being selected from the group consisting of the alkaline earth metals, calcium, strontium and barium and the second member being selected from the group consisting of the rare earth metals, lanthanum and other lanthanides, at least some portion of each element being present;

0.0–0.2% Carbon;

1.0–3.0% Silicon;

0.2–2.0% Manganese;

15.0–25.0% Chromium;

5.0–20.0% Nickel;

0.12–0.22% Nitrogen, said Nitrogen being added in amounts sufficient to assure that said alloy is fully austenitic;

0.0–2.0% total content of high oxygen affinity elements selected from the group consisting of yttrium and zirconium; and remainder iron and incidental impurities.

10. A structural member having improved high temperature creep resistance such that it exhibits only about 1% creep when subjected to a load of 16 Newtons per square millimeter for 1000 hours at a temperature of up to about 900° C., said member being formed from a fully austenitic steel alloy consisting of the following ingredients in percentages by weight:

0.02–0.07% total content of two elements, the first element being selected from the group consisting of the alkaline earth metals, calcium, strontium and barium and the second element being selected from the group consisting of the rare earth metals, lanthanum and other lanthanides, at least some portion of each element being present;

0.08–0.12% Carbon;

1.5–2.3% Silicon;

0.3–0.7% Manganese 19.0–22.0% Chromium;

8.0–12.0% Nickel;

0.12–0.22% Nitrogen, said Nitrogen being added in amounts sufficient to assure that said alloy is fully austenitic, 0.0–2.0% total content of high oxygen affinity elements selected from the group consisting of yttrium and zirconium; and remainder iron and incidental impurities.

* * * * *